US007299595B1

(12) United States Patent
Anderson, Sr.

(10) Patent No.: US 7,299,595 B1
(45) Date of Patent: Nov. 27, 2007

(54) SEAMED/SEAMLESS FABRIC WALL PANEL SYSTEM

(76) Inventor: Andy W. Anderson, Sr., 9041 Tarnwood Cir., Villa Rica, GA (US) 30180

( * ) Notice: Subject to any disclaimer, the term of this patent is extended or adjusted under 35 U.S.C. 154(b) by 644 days.

(21) Appl. No.: 10/798,222

(22) Filed: Mar. 11, 2004

Related U.S. Application Data

(63) Continuation-in-part of application No. 10/201,541, filed on Jul. 23, 2002, now Pat. No. 6,918,212.

(51) Int. Cl.

| | |
|---|---|
| ***E04B 2/00*** | (2006.01) |
| ***E04B 1/38*** | (2006.01) |
| ***E04F 13/00*** | (2006.01) |
| ***E04C 2/38*** | (2006.01) |
| ***E04C 3/30*** | (2006.01) |

(52) U.S. Cl. ..... 52/506.05; 52/311.1; 52/506.01; 52/716.8; 52/733.4; 52/282.1

(58) Field of Classification Search ..... 52/506.5, 52/506.06, 506.01, 506.08, 507, 511, 509, 52/716.8, 716.3, 716.4, 718.01, 718.04, 311.1, 52/311.3, 312, 733.4, 764, 273, 279, 281, 52/282.1, 284

See application file for complete search history.

(56) References Cited

U.S. PATENT DOCUMENTS

| | | | | |
|---|---|---|---|---|
| 3,667,177 | A * | 6/1972 | Biela | 52/278 |
| 3,830,027 | A | 8/1974 | Paisley et al. | |
| 4,018,260 | A | 4/1977 | Baslow | |
| 4,107,887 | A | 8/1978 | Wendt | |
| 4,459,790 | A | 7/1984 | Vermillion | |
| 4,527,370 | A | 7/1985 | Schuette | |
| 4,731,972 | A | 3/1988 | Anderson | |
| 5,535,556 | A | 7/1996 | Hughes, Jr. | |
| 5,715,638 | A | 2/1998 | Anderson, Sr. | |
| 5,836,113 | A * | 11/1998 | Bachman | 52/94 |
| 5,921,044 | A * | 7/1999 | Holztrager | 52/483.1 |
| 6,115,982 | A * | 9/2000 | Lindenberg | 52/506.05 |
| 6,158,915 | A | 12/2000 | Kise | |
| 6,622,452 | B2 | 9/2003 | Alvaro | |

* cited by examiner

*Primary Examiner*—Jeanette Chapman
*Assistant Examiner*—Elizabeth A Plummer
(74) *Attorney, Agent, or Firm*—Smith, Gambrell & Russell LLP

(57) ABSTRACT

A fabric wall panel system includes fabric wall panels mounted by means of a ceiling track with a downwardly open channel and a base track with a panel support surface. Each fabric wall panel is mounted by inserting the top of the fabric wall panel into the downwardly open channel and supporting the fabric wall panel on the panel support surface of the base track. The fabric wall panel may be custom fabricated to eliminate vertical seams or provided in standard size panels with vertical seams between panels. A corner trim piece hides the vertical seam at the corner of the room, a vertical seam trim piece hides the vertical seams, and an outside edge trim piece covers exposed edges of the wall panels. The base track includes a removable trim attachment strip with decorative trim. The base track may be used to trim around openings such as windows.

36 Claims, 4 Drawing Sheets

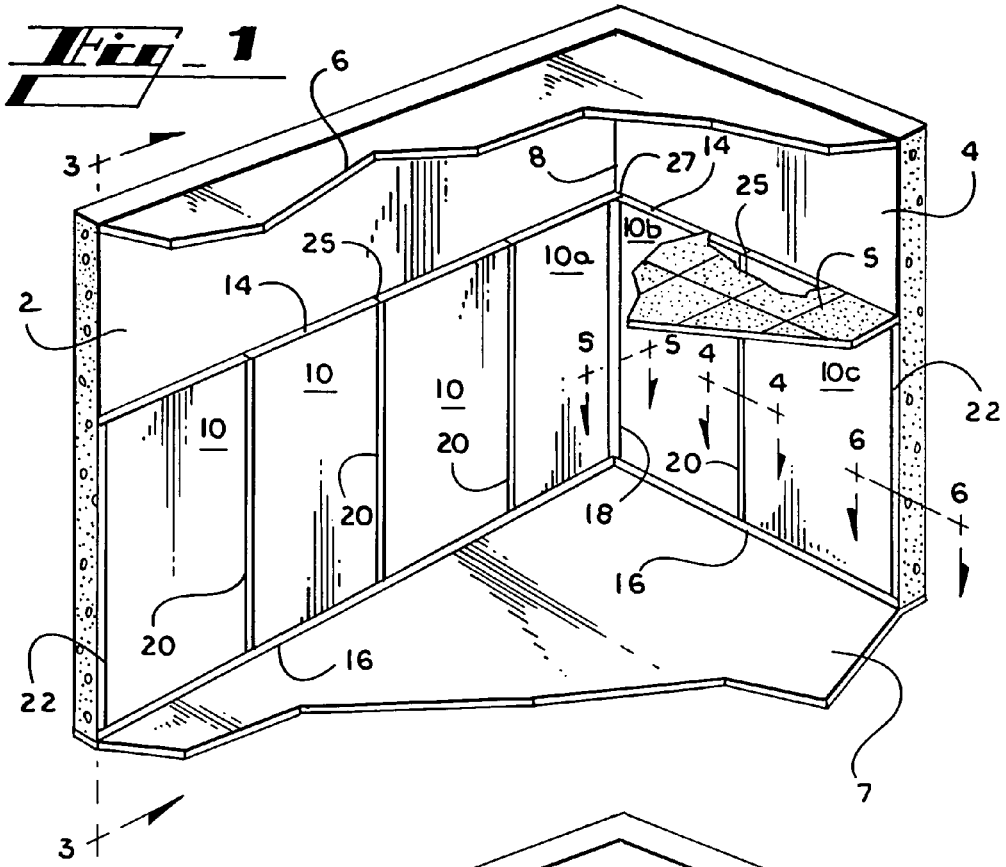
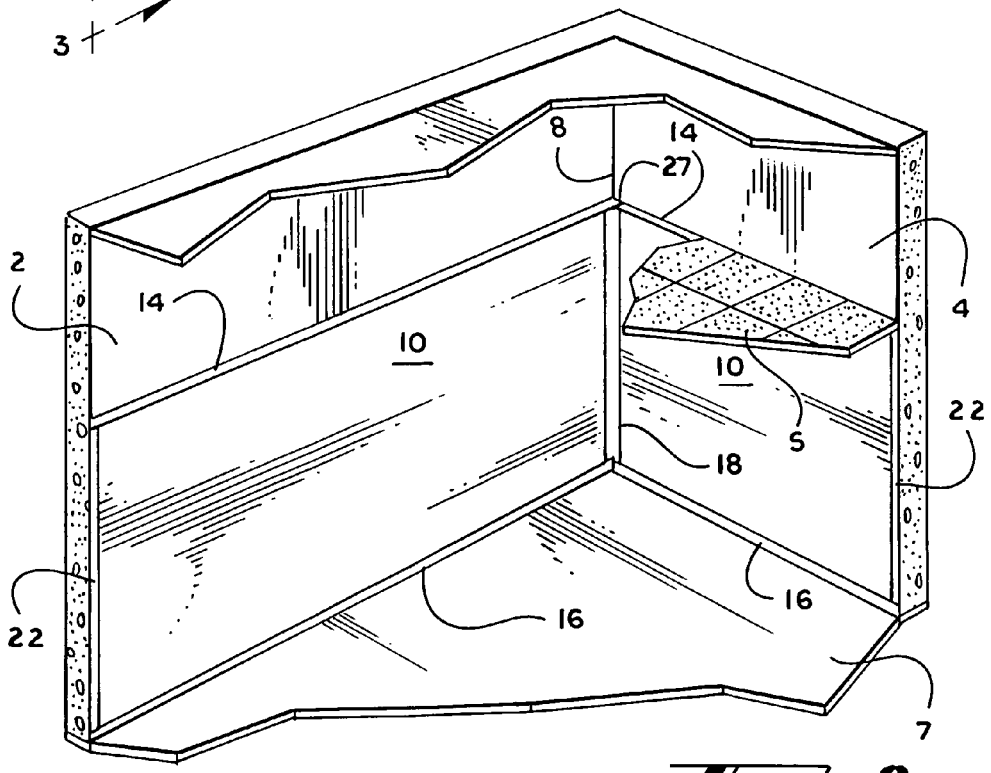
Fig. 2

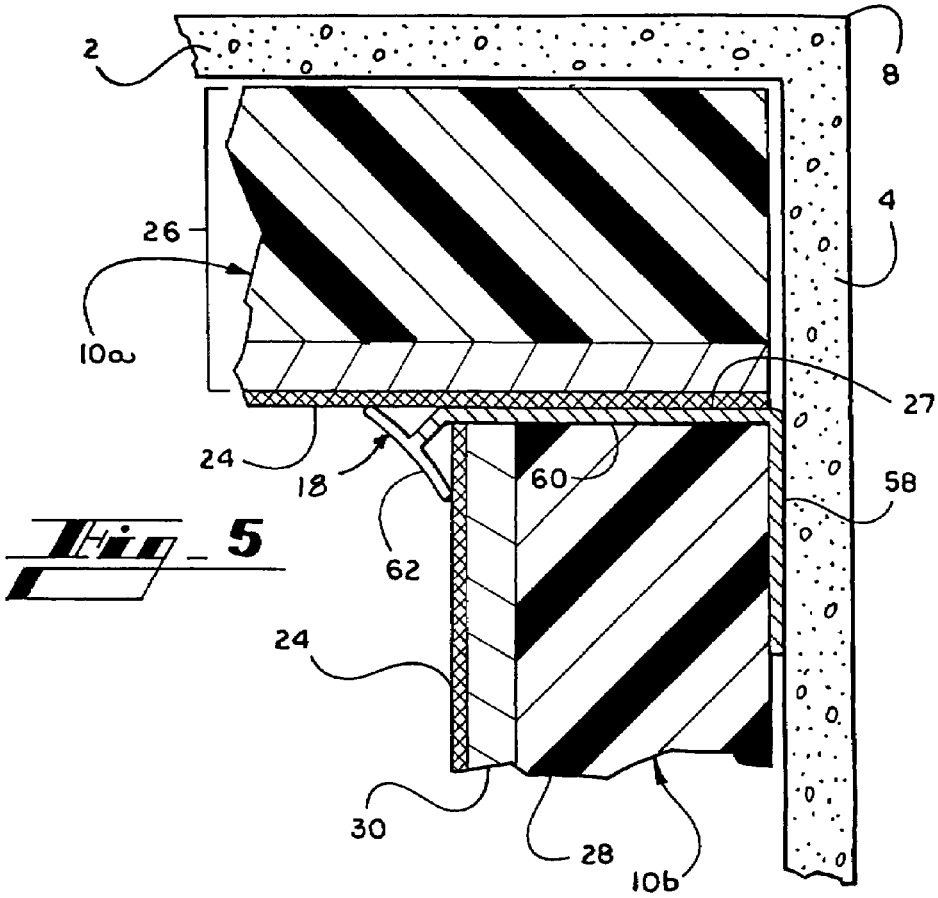
Fig. 5
Fig. 6
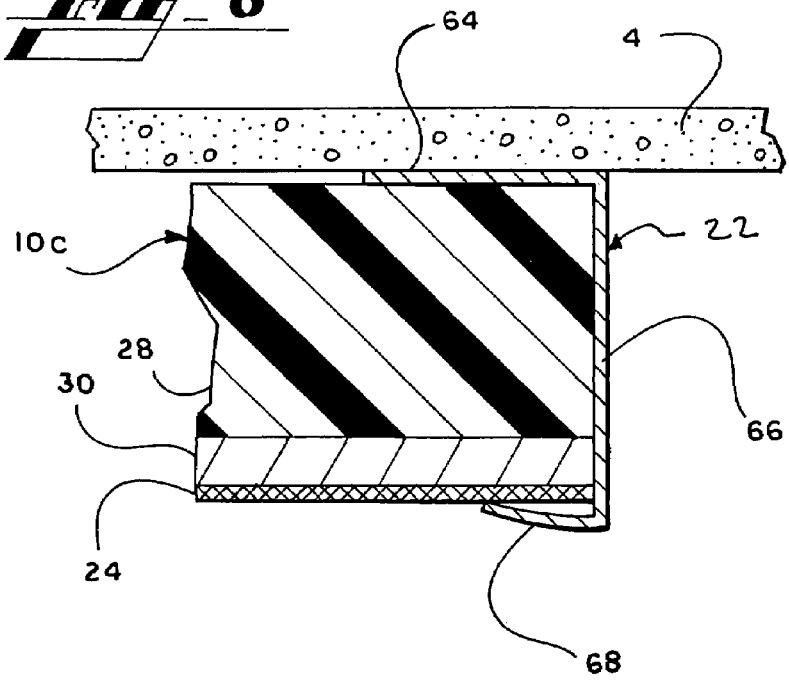

38
14
10
106
100
88
92
96
82
2
80
104
84
86
90
94
98
102
7

SEAMED/SEAMLESS FABRIC WALL PANEL SYSTEM

RELATED APPLICATION

This application is a continuation-in-part of U.S. patent application Ser. No. 10/201,541, filed Jul. 23, 2002, which is now U.S. Pat. No. 6,918,212.

FIELD OF THE INVENTION

This invention relates to a fabric wall panel system for decorating and insulating existing walls, and more particularly, relates to a fabric wall panel system having fabric wall panels which are mounted to a wall so that the vertical mid-wall seams are accented with decorative trim or so that the vertical mid-wall seams are eliminated altogether and to a fabric wall panel system having a trim piece attachment strip which allows removable attachment of trim pieces around the edges of the wall panel system. The invention also relates to the trim piece attachment strip itself for attaching architectural moldings and millwork to the walls of a room.

BACKGROUND OF THE INVENTION

Fabric wall panels are used to decorate the interior walls in many buildings. Fabric coverings for the panels are available in numerous textures and patterns which can be coordinated with the furnishings and carpets in a room. These fabric wall panels can be customized to meet the decorating needs of various locations and decorating tastes.

Besides decorating versatility, fabric wall panels provide other desirable features. Such features include sound and heat insulation. Particularly, in large rooms such as auditoriums and theaters, fabric wall panels may include a layer of acoustical material hidden behind the fabrics which modifies the acoustical character of the room. In addition, heat insulating material may be mounted behind the fabrics to inhibit heat transfer properties of a wall. Particularly, a basement wall of a building may require heat insulation because of the constant cooling resulting from the outside of the basement wall being in direct contact with the surrounding earth.

One consideration in the selection and use of a fabric wall panel system is assuring a quality installation. Particularly, the wall panels should line up uniformly with each other, and the vertical mid-wall seams between adjacent wall panels should either be eliminated or attractively trimmed. With most fabric wall panel systems, the quality of installation including finish of the vertical mid-wall seams depends on the skill of the installer. Employing skilled installers increases the cost of the fabric wall panel system. Such a consideration is particularly of concern in connection with home installations such as in a basement where cost is a crucial factor or where the homeowner undertakes installation without professional help.

A further consideration in the selection and installation of a fabric wall panel system is the proper installation of attractive trim pieces for the crown molding, the baseboard molding, and the molding or millwork around doors, windows, and other openings. In order to facilitate correct installation of such trim pieces, the fabric wall panel system should provide for easy and accurate attachment of the trim pieces as well as the ability to replace damaged trim pieces without requiring removal of the wall panels.

Some prior fabric wall panels are installed in situ. For example, as disclosed in Baslow U.S. Pat. No. 4,018,260, border pieces of a panel are permanently attached to the wall to form a framework for mounting a fabric sheet. The fabric sheet completely covers the wall without being adhered to the wall itself. The linear border pieces include a key way into which the fabric is forced by means of a compressible spline. The linear border pieces also include a storage channel, which allows the border pieces to create a finished look at the edges. The Baslow patent does not disclose a method of fabric wall panel prefabrication. The uniformity of installation depends on the skill of the installer in terms of aligning the framework and forcing the fabric into the keyway so that the fabric is uniformly stretched on the framework.

In addition, fabric wall panels can be prefabricated. One method for installing prefabricated fabric wall panels employs a cross-nailing system as disclosed by the patent to Anderson, U.S. Pat. No. 4,731,972. The fabric wall panels disclosed in the Anderson patent are prefabricated and then installed by driving two headless pin nails at an angle in a crossed fashion through the frame pieces of the prefabricated panels. The crossed nails penetrate completely through the fabric, partially penetrate the frame, and securely fasten the panel to the wall. A fabric wall panel attached using this cross-nailing method cannot be easily removed from the wall if one should desire to replace panels or remove the panels entirely. No provision is made for trimming the vertical mid-wall seams or eliminating the vertical mid-wall seams.

One successful removable fabric wall panel system is disclosed in Anderson U.S. Pat. No. 5,715,638. In that patent, the fabric wall panels are mounted on the wall by means of hangers. Each frame member of each wall panel has a spine with an elongated slit, a side edge, and a front edge which together define a groove. A flat filler insert is fitted within the groove of each frame member. Fabric is stretched over the frame and flat filler insert and is bonded to the back of the spine of each frame member to complete the finished fabric wall panel. The hanger has a flat base and a perpendicularly extending tongue with an enlarged head. A number of hangers are affixed on the wall using an adhesive. The slit on the frame of the fabric wall panel is aligned with the tongue of hanger on the wall, and the fabric wall panel is affixed to the wall by pressing the slit over the tongue on the hanger. The fabric wall panels can be prefabricated. The fabric wall panels can also be independently replaced or removed entirely by unsnapping the fabric wall panel from the supporting hangers. Again, no provision is made for trimming the vertical mid-wall seams or eliminating the vertical mid-wall seams.

Another successful fabric wall panel system has fabric wall panels that are removably mounted on the wall by means of a hanger. The frame of the fabric wall panel has a hollow channel along the edge of the frame member. The hollow channel engages the hanger, and the hanger thus holds each of the fabric wall panels in place on the wall. The frame members of adjacent wall panels are secured together to reduce the visibility of the mid-wall seams between the adjacent wall panels and to ensure a uniform width for the mid-wall seams between adjacent wall panels. Again, no provision is made for trimming the vertical mid-wall seams or eliminating the vertical seams.

The prior art has thus failed to disclose an easy to install fabric wall panel system in which the vertical mid-wall seams are trimmed or eliminated. In addition, the prior art does not disclose a trim piece attachment strip for removably installing architectural molding or millwork around the edges of the wall panel system or in connection with the existing walls of the room.

SUMMARY OF THE INVENTION

The present invention satisfies the above-described needs with a seamed or seamless fabric wall panel system for an existing wall and a method of installation. The fabric wall panel system of the present invention includes a hanger system and one or more fabric wall panels which are held on the existing wall by means of the hanger system. In addition to maintaining the fabric wall panels in position, the hanger system incorporates a trim piece attachment strip that allows the accurate and removable attachment of crown moldings, baseboard moldings, and moldings or millwork around doors, windows, and other openings in the walls of the room.

The fabric wall panel of the fabric wall panel system comprises a fabric cover overlaying a panel insert. In one embodiment, the panel insert comprises a sandwich of a foam layer and a backing layer. The foam layer is an open cell elastomeric foam. The backing layer may include rigid glass fiber insulation board or a mineral fiber board.

In one embodiment of the fabric wall panel system, the hanger system includes a ceiling track with a downwardly open channel mounted on the existing wall adjacent the ceiling and extending along the length of the existing wall and a base track with an upwardly depending support surface mounted on the existing wall adjacent the floor and extending along the length of the existing wall. The ceiling track of the hanger system has an outwardly protruding ledge which functions to support the outside perimeter for the tiles of a drop ceiling. The base track of the hanger system includes a vertical offset for raising the upwardly depending support surface above the floor in order to provide an attachment surface for a standard baseboard.

In another embodiment, the hanger system includes a trim piece attachment strip adjacent the ceiling and a similar trim piece attachment strip adjacent the baseboard. Particularly, the trim piece attachment strip is constructed in two pieces, one piece is attached to the wall and the other piece is attached to a standard baseboard molding or a standard crown molding. The two pieces of the trim piece attachment strip frictionally engage each other to allow easy mounting and removal of the baseboard molding and the crown molding to and from the wall of the room. The same trim piece attachment strip is also used to attach architectural moldings and millwork around windows, doors, and other openings.

For the fabric wall panel system with standard size fabric wall panels and vertical mid-wall seams, the hanger system also includes a seam trim piece for concealing the vertical mid-wall seams, a corner trim piece for concealing the vertical corner seams, and an outside edge trim piece for finishing any exposed vertical edge of the fabric wall panels where the fabric wall panel does not cover the entire area of an existing wall. The outside edge trim piece and the trim piece attachment strip with attached crown molding may also be used adjacent the ceiling when a drop-down ceiling is not employed.

For the seamless fabric wall panel system, the fabric wall panel is custom fabricated to fit the existing wall or specific area of the existing wall so that there are no vertical mid-wall seams. As with the seamed fabric wall panel system, the seamless fabric wall panel system employs the hanger system with the ceiling track, the base track, the corner trim pieces, the outside edge trim pieces, and/or trim piece attachment strips. Because there are no vertical mid-wall seams, the seamless fabric wall panel system does not utilize the seam trim pieces.

BRIEF DESCRIPTION OF THE DRAWINGS

FIG. 1 is a perspective view of a room having walls covered with a seamed fabric wall panel system in accordance with the present invention.

FIG. 2 is a perspective view of a room having walls covered with a seamless fabric wall panel system in accordance with the present invention.

FIG. 5 is a cross-section view of a fabric wall panel system with a corner trim piece in accordance with the present invention as seen along line 5-5 in FIG. 1.

FIG. 6 is a cross-section view of a fabric wall panel system with an outside edge trim piece in accordance with the present invention as seen along line 6-6 in FIG. 1.

DETAILED DESCRIPTION OF THE PREFERRED EMBODIMENT

Figure 3:
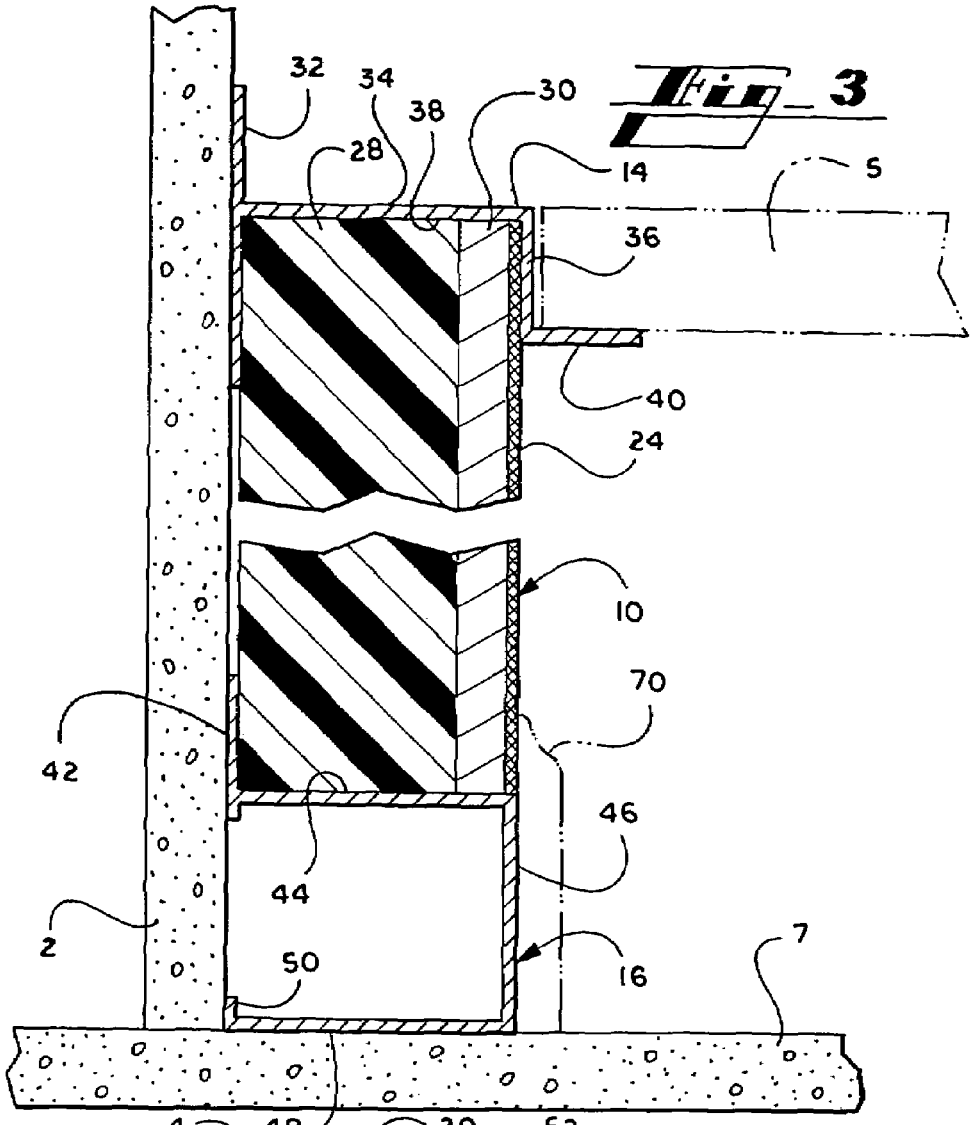
FIG. 3 is a cross-section view of a first embodiment of a fabric wall panel system with a ceiling track and a base track in accordance with the present invention as seen along line 3-3 in FIG. 1.

The present invention is a fabric wall panel system and method for installing fabric wall panels on an existing wall or walls of a room having a plurality of walls, a floor, and a ceiling and for installing attractive trim pieces, such as crown molding, baseboard molding, or other molding and millwork around windows, doors, or other openings. For the purposes of the present invention, a wall includes existing or permanent walls, moveable walls, partitions, and the like. Although the present invention will be generally described in the context of a residential basement room with concrete walls, those skilled in the art will recognize that the present invention is not limited to that environment. Referring now to the drawings, in which like numerals represent like elements throughout the several figures, the present invention will be described.

Figure 7:
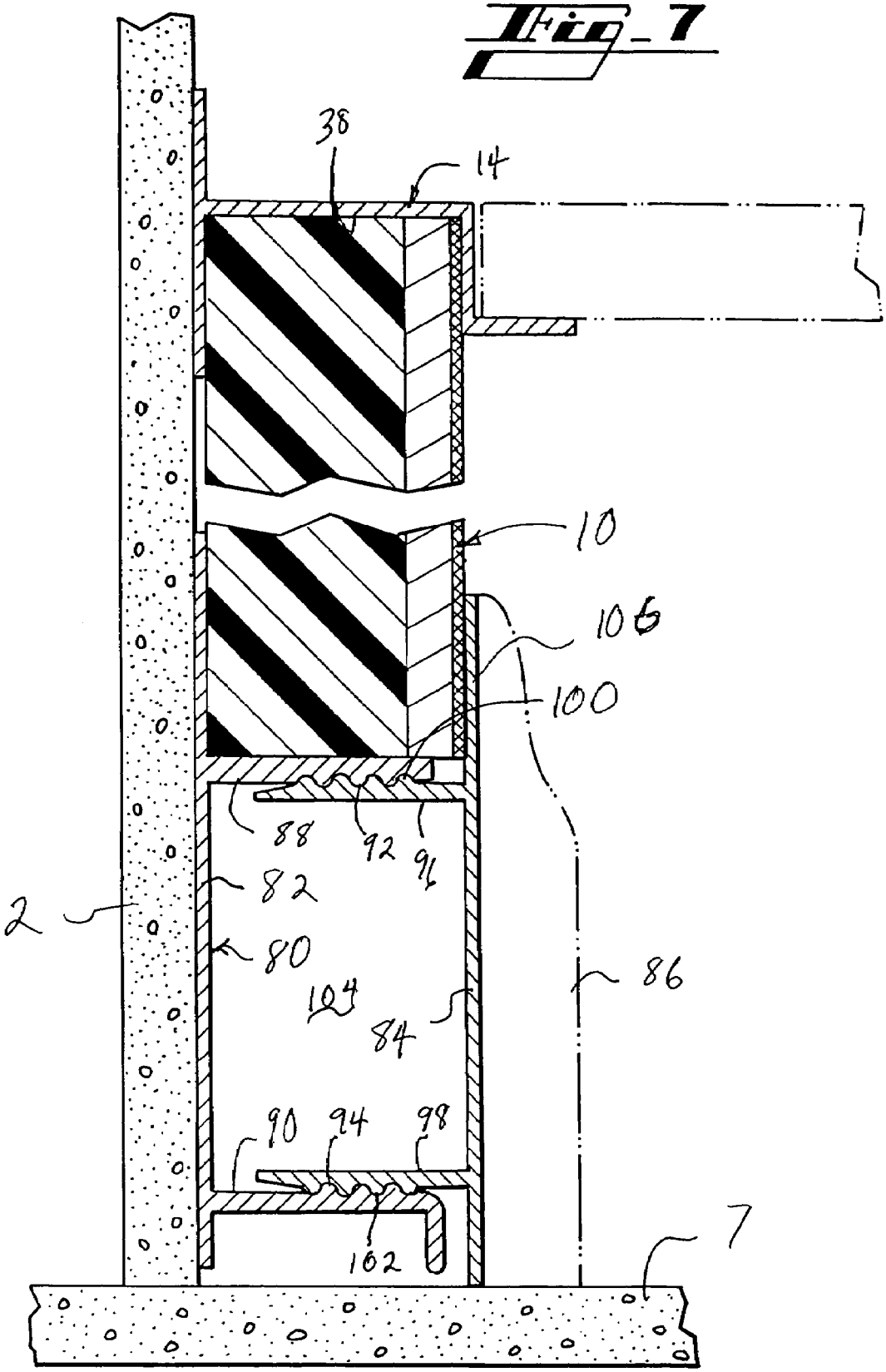
FIG. 7 is a cross-section view of a fabric wall panel system with a ceiling track and an alternative embodiment of the base track in accordance with the present invention as seen along line 3-3 in FIG. 1.

Turning to the figures, FIG. 1 is a perspective view of a room with a ceiling 6, a floor 7, and a plurality of walls including a back wall 2 and a side wall 4. The back wall 2 and side wall 4 converge at a corner 8. A drop ceiling 5 is installed below the ceiling 6. The back wall 2 and the side wall 4 are covered by a fabric wall panel system comprising a plurality of fabric wall panels 10 and a hanger system in accordance with the present invention. The fabric wall panels 10 are connected to the walls 2 and 4 by means of the hanger system comprising ceiling track 14, base track 16, corner trim piece 18, seam trim pieces 20, outside trim pieces 22, and/or a trim piece attachment strip 80 (FIG. 7). Particularly, the embodiment of the fabric wall panel system shown in FIG. 1 includes a plurality of fabric wall panels 10 which are pre-manufactured in standard sizes. Consequently, when the standard size fabric wall panels 10 in FIG. 1 are used to cover a wall, such as walls 2 and 4, more than one fabric wall panel 10 is required, and vertical mid-wall seams 25 are created between adjacent fabric wall panels 10.

Figure 4:
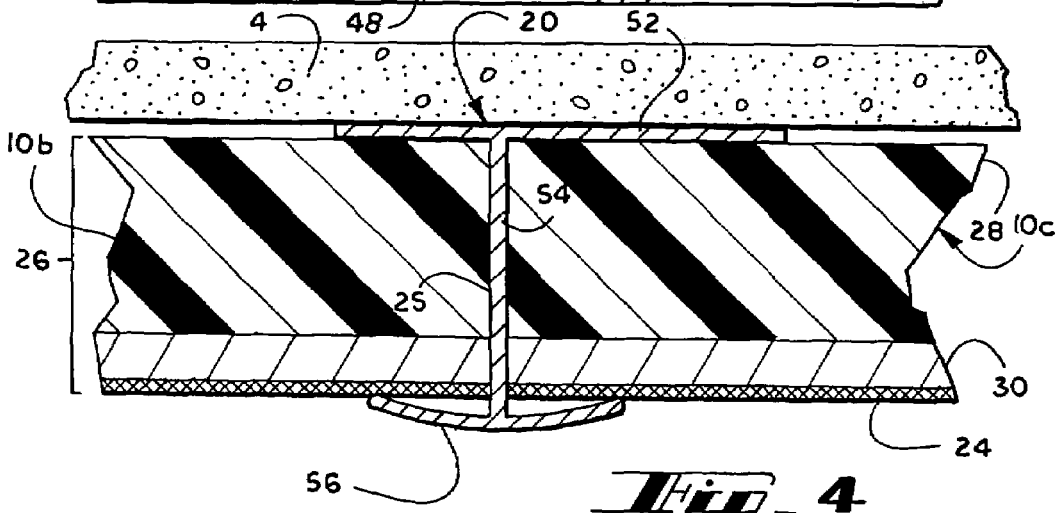
FIG. 4 is a cross-section view of a fabric wall panel system with a vertical seam trim piece in accordance with the present invention as seen along line 4-4 in FIG. 1.

One such vertical mid-wall seam 25 between adjacent fabric wall panels 10*b* and 10*c* is shown in detail in FIG. 4 with seam trim piece 20 installed.

FIG. 2 is a perspective view of the room of FIG. 1 with another embodiment of the fabric wall panel system in accordance with present invention. Instead of a plurality of fabric wall panels 10, as shown in FIG. 1, the fabric wall panel system shown in FIG. 2 has a single fabric wall panel 10 on the back wall 2 and a single fabric wall panel 10 on the side wall 4. Consequently, the hanger system for the embodiment shown in FIG. 2 does not include seam trim pieces 20 because no vertical mid-wall seams exist where a single fabric wall panel is used for each wall. In order to implement the seamless fabric wall panel system, the fabric wall panels are custom fabricated to the dimensions of the existing wall or walls or that area on the walls to be covered.

Except for size, each of the fabric wall panels 10 in FIG. 1 and FIG. 2 are similarly constructed. Each of the fabric wall panels 10 is a laminate comprising a fabric cover 24 and a panel insert 26 (FIG. 4 and FIG. 5). In one embodiment, the panel insert 26 comprises a backing layer 28 and a foam layer 30. In accordance with the present invention, the fabric cover 24, the foam layer 30, and the backing layer 28 of the fabric wall panel 10 are laminated together, generally by gluing to create a semi rigid panel. The fabric wall panel 10 is generally about two inches thick. The thickness, however, depends on design considerations that may very from installation to installation.

The outer fabric cover 24 of the fabric wall panel 10 may be selected from any number of fabrics including woven or nonwoven fabrics. The fabrics may be plain or patterned and have various textures. Particularly, the fabrics are selected for aesthetic appeal although fire resistance is considered in connection with the selection of an appropriate fabric for the fabric wall panel 10 of the present invention.

The foam layer 30 underlying the fabric cover 24 is a high density open cell elastomeric foam. The foam layer 30 is from ⅜ to ½ inch in thickness. The foam layer 30 provides sound and heat insulation for the fabric wall panel 10. Moreover, the foam layer 30 provides a resilient backing for the fabric cover 24 in order to provide a smooth appearance to the overlying fabric cover 24. The foam layer 30 may be an open cell elastomeric foam sold by Foamex International, Inc. of Linwood, Pa.

The backing layer 28 imparts rigidity to the fabric wall panel 10 as well as sound and heat insulation. The backing layer 28 may be an acoustical insert in the nature of a rigid board such as Owens/Corning 705 Fiberglas insulation board sold by Owens/Corning Fiberglas Corp. of Toledo, Ohio.

Turning to FIG. 3, the ceiling track 14 and the base track 16 are shown in cross-section mounted to the back wall 2. The fabric wall panel 10 is shown mounted between the ceiling track 14 and the base track 16.

The ceiling track 14 comprises a ceiling attachment strip 32, a top leg 34, a return leg 36, and an outwardly protruding ledge 40. The ceiling track 14 is mounted on the back wall 2 by attaching the ceiling attachment strip 32 to the back wall 2. The attachment of the ceiling attachment strip 32 to the back wall 2 may be accomplished by means of glue, nails, or other suitable fastener. Together, the ceiling attachment strip 32, the top leg 34, and return leg 36 form a downwardly open channel 38. As can be seen clearly in FIG. 3, the top edge of the fabric wall panel 10 is retained within the downwardly open channel 38. In addition, the drop ceiling 5 is supported around the perimeter of the room by means of the outwardly protruding ledge 40.

The base track 16 shown in FIG. 3 comprises a base attachment strip 42, and upwardly depending support surface 44, a vertical offset 46, a floor piece 48, and a wall stop 50. The base track 16 is mounted on the back wall 2 by attaching the base attachment strip 42 to the back wall 2. The attachment of the base attachment strip 42 to the back wall 2 may be accomplished by means of glue, nails, or other suitable fastener. The upwardly depending support surface 44 is in turn supported by the vertical offset 46 and the floor piece 48. The wall stop 50 rests against the wall 2. As can be seen in FIG. 3, the upwardly depending support surface 44 engages the bottom edge of the wall panel 10 to support it so that the top edge of the fabric wall panel 10 is retained in the downwardly depending channel 38 of the ceiling track 14. In addition, the vertical offset 46 provides a contact surface for a standard baseboard 70. Particularly, the standard baseboard 70 can be attached to the vertical offset 46 by means of glue, nails, or other suitable fastener. When nails or other fasteners are used for attachment of the baseboard 70, the wall stop 50 in conjunction with the floor piece 48 and the upwardly depending surface 44 provide stability to the vertical offset 46 when a force parallel to the floor is exerted on the vertical offset 46 during the fastening process. The standard baseboard 70 provides a finished look to the fabric wall panel system around the floor 7 of the room.

Turning to FIG. 4, a seam trim piece 20 is shown at a vertical mid-wall seam 25 between two adjacent fabric wall panels 10*b* and 10*c* of the side wall 4. The seam trim piece 20 comprises a seam trim base 52, a seam trim leg 54, and a seam trim keeper 56. The seam trim piece 20 is mounted on the side wall 4 by attaching the seam trim base 52 to the side wall 4. The attachment of the seam trim base 52 to the side wall 4 may be accomplished by means of glue, nails, or other suitable fastener. The seam trim leg 54 extends through the vertical mid-wall seam 25 between the adjacent fabric wall panels 10*b* and 10*c* and terminates in the seam trim keeper 56. The seam trim keeper 56 spans the width of the vertical mid-wall seam 25 between the two adjacent fabric wall panels 10*b* and 10*c* and hides the vertical mid-wall seam 25. In addition, the combination of the seam trim base 52, the seam trim leg 54, and the seam trim keeper 56 provides a channel on each side of the seam trim leg 54 for holding each of the adjacent fabric wall panels 10*b* and 10*c* against the side wall 4.

Turning FIG. 5, a corner trim piece 18 is shown at the vertical corner seam 27 between two adjacent fabric wall panels 10*a* and 10*b* at the corner 8 between the back wall 2 and the side wall 4. The corner trim piece 18 comprises a corner trim base 58, a corner trim leg 60, and a corner trim keeper 62. The corner trim piece 18 is mounted on the side wall 4 by attaching the corner trim base 58 to the side wall 4. The attachment of the corner trim base 58 to the side wall 4 may be accomplished by means of glue, nails, or other suitable fastener. The corner trim leg 60 extends through the vertical corner seam 27 at the corner 8 between the adjacent fabric wall panels 10*a* and 10*b* and terminates in the corner trim keeper 62. The corner trim keeper 62 spans the width of the vertical corner seam 27 at the corner 8 between the two adjacent fabric wall panels 10*a* and 10*b* and conceals the vertical corner seam 27. In addition, the combination of the corner trim base 58 and the corner trim leg 60 holds one of the fabric panels 10*a* against the back wall 2. Moreover, the combination of the corner trim base 58, the corner trim leg 60, and the corner trim keeper 62 provides a channel for holding the other adjacent fabric wall panel 10*b* against the side wall 4.

Turning to FIG. 6, an outside edge trim piece 22 is shown at the unfinished right hand vertical edge of the fabric wall panel 10*c* along the side wall 4. The outside edge trim piece 22 comprises an edge trim base 64, an edge trim leg 66, and an edge trim keeper 68. The edge trim piece 22 is mounted on the side wall 4 by attaching the edge trim base 64 to the side wall 4. The attachment of the edge trim base 64 to the side wall 4 may be accomplished by means of glue, nails, or other suitable fastener. The edge trim leg 66 extends around the unfinished right hand edge of the fabric wall panel 10*c* and terminates in the edge trim keeper 68. Together the edge trim leg 66 and the edge trim keeper 68 wrap around the unfinished right hand edge of the fabric wall panel 10*c* and hide the unfinished edge. In addition, the combination of the edge trim base 64, the edge trim leg 66, and the edge trim keeper 68 provides a channel for holding the fabric wall panel 10*c* against the side wall 4.

Alternatively, where the fabric wall panels 10 extend all the way to the ceiling 6 of the room, and the drop ceiling 5 is not employed, the edge trim piece 22 may be used in place of the ceiling track 14 at the junction between the back wall 2 and the side wall 4 with the ceiling 6. Consequently, the edge trim piece 22 provides a downwardly open channel formed by the edge trim base 64, the edge trim leg 66, and the edge trim keeper 68.

In order to install the fabric wall panel system shown in FIG. 1, the workmen begin by installing the base tracks 16 along the length of the walls including the back wall 2 and the side wall 4 at the junction with the floor 7. Next, the ceiling tracks 14 are installed along the length of the walls including the back wall 2 and the side wall 4. The ceiling tracks 14 may be installed below the ceiling 6 of the room in order to accommodate the drop ceiling 5. Alternatively, the edge trim pieces 22 may be installed on the walls, including the walls 2 and 4, at the junction with the ceiling 6 to provide the downwardly open channel necessary for retaining the top edge of the fabric wall panels 10. The following discussion, however, will focus on the installation using the ceiling tracks 14 with the installation of the drop ceiling 5.

Once the ceiling tracks 14 and the base tracks 16 have been installed as shown in FIG. 1, the corner trim pieces 18 are attached adjacent to the corners of the room as shown in FIG. 5. Beginning at one corner, such as corner 8, and moving to the right in FIG. 1, the top edge of the first fabric wall panel 10*b* adjacent corner 8 is inserted into the downwardly open track 38 of the ceiling track 14. The bottom edge of the first fabric wall panel 10*b* is then urged toward the side wall 4 and rested on the upwardly depending support surface 44 of the base track 16. Once the first fabric wall panel 10*b* has been inserted between the ceiling track 14 and the base track 16, the fabric wall panel 10*b* is slid toward the corner 8 so that the left-hand edge of the fabric wall panel 10*b* engages the corner trim keeper 62 of the corner trim piece 18 at the corner 8.

Next, a seam trim piece 20 is installed on the right hand edge of the fabric wall panel 10*b* as shown in FIG. 4. Once the seam trim piece 20 has fully engaged the right hand edge of the fabric wall panel 10*b*, the seam trim base 52 is fastened to the wall completing the installation of the first fabric wall panel 10*b* to the right of corner 8. The next fabric wall panel 10*c* to the right of corner 8 is similarly engaged in the downwardly open channel 38 of the ceiling track 14, supported on the upwardly depending support surface 44, and slid into engagement with the channel of the seam trim piece 20. Installation of the standard size fabric wall panels 10 continues until the walls of the room are covered. When the last standard size fabric wall panel 10*a* is installed at the last corner 8 of the room, the width of the last fabric wall panel 10 may be adjusted in order to allow the fabric wall panels 10 along back wall 2 to first slide all the way to the right into corner 8 so that the left most panel can slide by the corner trim keeper 62 into engagement with the side wall 2. Once the last fabric wall panel 10 is in engagement with the wall, the fabric wall panels 10 on back wall 2 are slid to the left in order to fully engage the corner trim keeper 62 while still in engagement with the channel of the seam trim piece 20 at the right hand edge of the last fabric wall panel 10*a*.

Installation of the seamless fabric wall panel system of FIG. 2 is similar to the installation described with respect to FIG. 1. By contrast, however, a single fabric wall panel 10 is constructed on-site to the exact dimensions of the portion of the wall to be covered. In order to accommodate the full-size single fabric wall panel 10, each full-size fabric wall panel 10 must be just slightly shorter than the length of the back wall 2, for example, in order to allow the left-hand edge of the full-size fabric wall panel 10 to slide by the corner trim keeper at the corner on the left-hand side of back wall 2. Particularly, the right hand edge of the full-size fabric wall panel 10 is abutted against side wall 4 at corner 8. Because the full-size fabric wall panel 10 is slightly shorter than the length of the back wall 2, there is room to slide the left-hand edge of the fabric wall panel 10 past the corner trim keeper 62 and against the corner trim base 58 at the corner on the left-hand side of back wall 2. The full-size fabric wall panel 10 is then slid to the left in FIG. 2 in order to fully engage the corner trim keeper 62. Thus in accordance with the present invention, the full-size fabric wall panels 10 are considered approximately equal to the length of the wall when the length of the fabric wall panels 10 is less than the length of the wall to accommodate the width of the corner trim keeper 62.

Turning to FIG. 7, another embodiment of the fabric wall panel system is shown. Particularly, the trim piece attachment strip 80 is shown as a replacement for the base track 16 shown in FIG. 3. The trim piece attachment strip 80, however, could also be used as a replacement for the ceiling track 14. The trim piece attachment strip 80 comprises a fixed trim attachment strip 82 and a removable trim attachment strip 84. The fixed trim attachment strip 82 comprises a first connector web 88 and a second connector web 90. The first connector web 88 has a series of ribs 92 extending along the length of the first connector web 88, and the second connector web 90 has a series of ribs 94 extending along the length of the second connector web 90. The first connector web 88, the second connector web 90, and the associated ribs 92 and 94 form a first frictionally engageable connector as part of the fixed trim attachment strip 82.

The removable trim attachment strip 84 comprises a first engagement web 96, a second engagement web 98, and a base panel keeper 106. The first engagement web 96 has a series of ribs 100 extending along the length of the first engagement web 96, and the second engagement web 98 has a series of ribs 102 extending along the length of the second engagement web 98. A trim piece 86 (a baseboard shown in FIG. 7) is attached to the removable trim attachment strip 84 by means of glue or other suitable attachment means. Alternatively, the trim piece 86 may be integrally formed with the removable trim attachment strip 84. The first engagement web 96, the second engagement web 98, and the associated ribs 100 and 102 form a second frictionally engageable connector as part of the removable trim attachment strip 84.

Because the first connector web 88, the second connector web 90, the first engagement web 96, and the second engagement web 98 are flexible, the removable trim attachment strip 84 can frictionally engage and disengage the fixed trim attachment strip 82 as complementary ribs 92 and 100 and 94 and 102 ride over each other as the removable trim attachment strip 84 moves in a direction parallel to the floor 7. Other suitable frictionally engagement profiles may be used instead of the ribs 92, 94, 100, and 102 to form the first and second frictionally engageable connectors.

In order to construct the fabric wall panel system shown in FIG. 7, the ceiling track 14 is installed as previously described. Alternatively, the trim piece attachment strip 80 could be installed in place of the ceiling track 14 shown in FIG. 7. With respect to the installation of the trim piece attachment strip 80 adjacent the floor 7, the fixed trim attachment strip 82 is attached to the back wall 2. The attachment of the fixed trim attachment strip 82 to the back wall 2 may be accomplished by means of glue, nails, or other suitable fastener. As can be seen in FIG. 7, the wall panel 10 is inserted into the channel 38 in the ceiling track 14, and the first connector web 88 engages the bottom edge of the wall panel 10 to support the wall panel 10. The first connector web 88 performs the dual function of supporting the bottom edge of the wall panel 10 as well as frictionally engaging with the removable trim attachment strip 84.

Once the fabric wall panel 10 is in place, the removable trim attachment strip 84 with its previously attached trim piece 86 is urged toward the back wall 2 and into engagement with the fixed base attachment strip 82. Because the first connector web 88, the second connector web 90, the first engagement web 96, and the second engagement web 98 are flexible, the removable trim attachment strip 84 can engage and disengage the fixed trim attachment strip 82 as the complementary ribs 92 and 100 and 94 and 102 ride over each other as the removable trim attachment strip 84 moves in a direction parallel to the floor 7. As the ribs 92 and 100 and 94 and 102 ride over each other, the interlocking action of the ribs retains the removable trim attachment strip 84 in place at a series of fixed distances from the back wall 2. The adjustability provided by the series of ribs allows the base panel keeper 106 to accommodate wall panels of differing thicknesses.

While it is preferred that the first connector web 88, the second connector web 90, the first engagement web 96, and the second engagement web 98 extend along the entire length of the trim piece attachment strip 80, the present invention also contemplates discrete lengths of the engagement webs 96 and 98 and connector webs 88 and 90 disposed along the length of the trim piece attachment strip 80.

Once the removable trim attachment strip 84 is in place as shown in FIG. 7, the removable trim attachment strip 84 and the fixed trim attachment strip 82 define a chase 104 running the length of the trim piece attachment strip 80. The chase 104 is useful for routing wiring.

While the trim piece attachment strip 80 as useful for retaining the bottom of the fabric panel 10 around the baseboard of a room, as shown in FIG. 7, one of ordinary skill in the art will readily appreciate that the trim piece attachment strip 80 may be used to removably secure crown moldings adjacent the ceiling of the room and to removably secure trim around openings such as windows and doors within the room. In addition the trim piece attachment strip is useful to removably secure other architectural features, such as columns, chair rails, and the like, to existing walls.

The hanger system components, ceiling track 14, base track 16, corner trim piece 18, seam trim piece 20, and outside trim piece 22, are extrusions made of polyvinyl chloride (PVC). A PVC designated 7045 White 08 PVC sold by Georgia Gulf Corporation of Plaquemine, La., is useful in connection with the present invention. The trim piece attachment strip 80 is made of high impact polystyrene which provides the flexibility need for the engagement between the fixed trim attachment strip 82 and the removable trim attachment strip 84, as well as toughness necessary to resist shattering when nailed to the wall.

In summary, the present invention provides an improved and simplified fabric wall panel system for installing fabric wall panels employing a simple hanger system which is easy to install. Moreover, the fabric wall panel system of the present invention allows for the installation of a fabric wall panel system with trimmed seams using standard size fabric wall panels or for the seamless installation using on-site constructed full-sized fabric wall panels.

Alternative embodiments will become apparent to those skilled in the art to which the present invention pertains without departing from its spirit and scope. Accordingly, the scope of the present invention is defined by the appended claims rather than the foregoing description.

I claim:

1. A fabric wall panel system for covering an existing wall in a room having a plurality of walls, a ceiling, a floor, and an opening, the fabric wall panel system comprising:

a. a fabric wall panel comprising a fabric cover overlaying a panel insert; and b. a hanger system attached to the existing wall comprising:

i. a ceiling track with a downwardly open channel mounted on the existing wall adjacent the ceiling; and ii. a base track comprising:

(a) a fixed base attachment strip mounted on the existing wall adjacent the floor and including a base portion attached to the existing wall, a panel support surface, and a first frictionally engageable connector, comprising:

(i) a first upper connector web extending from the base portion with friction engaging ribs; and (ii) a second lower connector web extending from the base portion with friction engaging ribs, and (b) a removable trim attachment strip with a base panel keeper and a second frictionally engageable connector for engaging the first frictionally engageable connector, the second frictionally engageable connector comprising:

(i) a first upper engagement web extending from the base panel keeper with friction engaging ribs for engaging the first upper connector web; and (ii) a second lower engagement web extending from the base panel keeper with friction engaging ribs for engaging the second lower connector web, and (c) a chase formed along the length of the base track by the base portion of the fixed base attachment strip, the first upper connector web, the first upper engagement web, the base panel keeper, the second lower connector web, and the second lower engagement web, wherein a top edge of the fabric wall panel is retained in the downwardly open channel of the ceiling track and a bottom edge of the fabric wall panel is supported by the panel support surface of the base track and held in place by the keeper when the removable trim attachment strip is connected to the fixed base attachment strip.

2. The fabric wall panel system of claim 1, wherein the existing wall has a height and a length, and the fabric wall panel has a panel length approximately equal to the length of the existing wall so that no vertical seams exist along the panel length, and the fabric wall panel has a panel height approximately equal to a distance between the downwardly open channel of the ceiling track and the panel support surface of the base track so that no horizontal seams exist along the panel height.

3. The fabric wall panel system of claim 2, wherein adjacent walls in the room form a corner and wherein at least two fabric wall panels meet at the corner with a vertical corner seam between the adjacent panels and wherein the fabric wall panel system further includes a corner trim piece to hide the vertical corner seam.

4. The fabric wall panel system of claim 3, wherein the corner trim piece comprises a corner trim base, a corner trim leg, and a corner trim keeper wherein the corner trim base is attached to one of the adjacent walls, the corner trim leg is attached to the corner trim base and extends from the corner trim base through the vertical corner seam, and the corner trim keeper is attached to the corner trim leg and extends across the vertical corner seam.

5. The fabric wall panel system of claim 2, wherein the ceiling track further includes an outwardly protruding ledge for supporting an edge of a drop ceiling.

6. The fabric wall panel system of claim 2, wherein the removable trim attachment strip of the base track includes a decorative trim piece.

7. The fabric wall panel system of claim 2, wherein the base track is further mounted on the existing wall adjacent the opening.

8. The fabric wall panel system of claim 7, wherein the removable trim attachment strip of the base track includes a decorative trim piece.

9. The fabric wall panel system of claim 2, wherein the panel insert of the fabric wall panel comprises a foam layer and a backing layer.

10. The fabric wall panel system of claim 1, wherein the existing wall has a height and a length and the fabric wall panel has a panel length substantially less than the length of the existing wall and the fabric wall panel has a panel height approximately equal to a distance between the downwardly open channel of the ceiling track and the panel support surface of the base track so that a plurality of fabric wall panels are required to cover the existing wall and as result, at least one vertical seam exists between adjacent fabric wall panels on the existing wall.

11. The fabric wall panel system of claim 10, wherein a seam trim piece hides the vertical seam, wherein the seam trim piece comprises a seam trim base, a seam trim leg, and a seam trim keeper, and wherein the seam trim base is attached to the existing wall, the seam trim leg is attached to the seam trim base and extends from the seam trim base through the vertical seam, and the seam trim keeper is attached to the seam trim leg and extends across the vertical seam.

12. The fabric wall panel system of claim 10, wherein adjacent walls in the room form a corner and wherein at least two fabric wall panels meet at the corner with a vertical corner seam between the adjacent panels and wherein the fabric wall panel system further includes a corner trim piece to hide the vertical corner seam.

13. The fabric wall panel system of claim 12, wherein the corner trim piece comprises a corner trim base, a corner trim leg, and a corner trim keeper wherein the corner trim base is attached to one of the adjacent walls, the corner trim leg is attached to the corner trim base and extends from the corner trim base through the vertical corner seam, and the corner trim keeper is attached to the corner trim leg and extends across the vertical corner seam.

14. The fabric wall panel system of claim 10, wherein the ceiling track further includes an outwardly protruding ledge for supporting an edge of a drop ceiling.

15. The fabric wall panel system of claim 10, wherein the removable trim attachment strip of the base track includes a decorative trim piece.

16. The fabric wall panel system of claim 10, wherein the base track is further mounted on the existing wall adjacent the opening.

17. The fabric wall panel system of claim 16, wherein the removable trim attachment strip of the base track includes a decorative trim piece.

18. The fabric wall panel system of claim 10, wherein the panel insert of the fabric wall panel comprises a foam layer and a backing layer.

19. A method for installing a fabric wall panel system on an existing wall having a height and a length, in a room having a plurality of walls, a ceiling, a floor, and an opening, the method comprising:

a. attaching a ceiling track to the existing wall adjacent the ceiling along the length of the existing wall, wherein the ceiling track has a downwardly open channel;

b. attaching a fixed base attachment strip of a base track to the existing wall adjacent the floor along the length of the floor, wherein the fixed base attachment strip includes a base portion attached to the existing wall, a panel support surface, and a first frictionally engageable connector, comprising:

i. a first upper connector web extending from the base portion with friction engaging ribs; and ii. a second lower connector web extending from the base portion with friction engaging ribs;

c. inserting a top edge of a fabric wall panel, comprising a fabric cover overlaying a panel insert, into the downwardly open channel;

d. engaging a bottom edge of the fabric wall panel against the panel support surface of the base track;

e. attaching a removable trim attachment strip with a base panel keeper and a second frictionally engageable connector to the first frictionally engageable connector, the second frictionally engageable connector comprising:

i. a first upper engagement web extending from the base panel keeper with friction engaging ribs for engaging the first upper connector web; and ii. a second lower engagement web extending from the base panel keeper with friction engaging ribs for engaging the second lower connector web; and f. forming a chase along the length of the base track by engaging the first frictionally engageable connector with the second frictionally engageable connector, the chase comprising the base portion of the fixed base attachment strip, the first upper connector web, the first upper engagement web, the base panel keeper, the second lower connector web, and the second lower engagement web.

20. The method for installing a fabric wall panel system of claim 19, wherein the method further includes:

a. custom fabricating a fabric wall panel, wherein the custom fabricated fabric wall panel has a panel length approximately equal to the length of the existing wall and a panel height approximately equal to a distance between the downwardly open channel of the ceiling track and the panel support surface of the base track, and b. installing the custom fabricated fabric wall panel in accordance with steps (c), (d), and (e) of claim 19.

21. The method for installing a fabric wall panel system of claim 20, wherein adjacent walls in the room form a corner and wherein at least two fabric wall panels meet at the corner with a vertical corner seam between the two adjacent fabric wall panels, the method further comprising inserting a corner trim piece into the vertical corner seam to hide the vertical corner seam.

22. The method for installing a fabric wall panel system of claim 21, wherein the corner trim piece comprises a corner trim base attached to a corner trim leg and the corner trim leg in turn is attached to a corner trim keeper, wherein the method further comprises:

a. attaching the corner trim base to one of the adjacent walls and engaging one of the adjacent fabric wall panels by the corner trim leg and the corner trim keeper, and b. installing the other adjacent fabric wall panel against the corner trim leg and behind the corner trim keeper so that the vertical corner seam is hidden by the corner trim keeper.

23. The method for installing a fabric wall panel system of claim 20, wherein the ceiling track further includes an outwardly protruding ledge for supporting an edge of a drop ceiling.

24. The method for installing a fabric wall panel system of claim 20, wherein the removable trim attachment strip of the base track includes a decorative trim piece.

25. The method for installing a fabric wall panel system of claim 20, wherein the method further includes attaching the fixed base attachment strip to the existing wall adjacent the opening and attaching the removable trim attachment strip with the base panel keeper and a second frictionally engageable connector to the first frictionally engageable connector.

26. The method for installing a fabric wall panel system of claim 25, wherein the removable trim attachment strip of the base track includes a decorative trim piece.

27. The method for installing a fabric wall panel system of claim 20, wherein the panel insert of the fabric wall panel comprises a foam layer and a backing layer.

28. The method for installing a fabric wall panel system of claim 19, wherein the existing wall has a height and a length and the fabric wall panel has a panel length substantially less than the length of the existing wall and the fabric wall panel has a panel height approximately equal to a distance between the downwardly open channel of the ceiling track and the upwardly depending support surface of the base track so that a plurality of fabric wall panels are required to cover the existing wall, installing the fabric wall panel in accordance with steps (c), (d), and (e) of claim 19, and as a result, at least one vertical seam exists between adjacent fabric wall panels on the existing wall.

29. The method for installing a fabric wall panel system of claim 28, wherein a seam trim piece hides the vertical seam, wherein the seam trim piece comprises a seam trim base, a seam trim leg, and a seam trim keeper, and wherein the seam trim base is attached to the existing wall, the seam trim leg is attached to the seam trim base and extends from the seam trim base through the vertical seam, and the seam trim keeper is attached to the seam trim leg and extends across the vertical seam.

30. The method for installing a fabric wall panel system of claim 28, wherein adjacent walls in the room form a corner and wherein at least two fabric wall panels meet at the corner with a vertical corner seam between the two adjacent fabric wall panels, the method further comprising inserting a corner trim piece into the vertical corner seam to hide the vertical corner seam.

31. The method for installing a fabric wall panel system of claim 30, wherein the corner trim piece comprises a corner trim base attached to a corner trim leg and the corner trim leg in turn is attached to a corner trim keeper, wherein the method further comprises:

a. attaching the corner trim base to one of the adjacent walls and engaging one of the adjacent fabric wall panels by the corner trim leg and the corner trim keeper, and b. installing the other adjacent fabric wall panel against the corner trim leg and behind the corner trim keeper so that the vertical corner seam is hidden by the corner trim keeper.

32. The method for installing a fabric wall panel system of claim 28, wherein the ceiling track further includes an outwardly protruding ledge for supporting an edge of a drop ceiling.

33. The method for installing a fabric wall panel system of claim 28, wherein the removable trim attachment strip of the base track includes a decorative trim piece.

34. The method for installing a fabric wall panel system of claim 28, wherein the method further includes attaching the fixed base attachment strip to the existing wall adjacent the opening and attaching the removable trim attachment strip with the base panel keeper and a second frictionally engageable connector to the first frictionally engageable connector.

35. The method for installing a fabric wall panel system of claim 34, wherein the removable trim attachment strip of the base track includes a decorative trim piece.

36. The method for installing a fabric wall panel system of claim 28, wherein the panel insert of the fabric wall panel comprises a foam layer and a backing layer.

* * * * *